US012297587B2

(12) United States Patent
Cartabbia

(10) Patent No.: US 12,297,587 B2
(45) Date of Patent: May 13, 2025

(54) FINISHING TUNNEL FOR IRONING DRY GARMENTS AND SIMILAR PRODUCTS

(71) Applicant: MACPI S.P.A. PRESSING DIVISION, Palazzolo sull'Oglio (IT)

(72) Inventor: Paolo Cartabbia, Palazzolo sull'Oglio (IT)

(73) Assignee: MACPI S.P.A. PRESSING DIVISION, Palazzolo sull'Oglio (IT)

( * ) Notice: Subject to any disclaimer, the term of this patent is extended or adjusted under 35 U.S.C. 154(b) by 0 days.

(21) Appl. No.: 18/434,021

(22) Filed: Feb. 6, 2024

(65) Prior Publication Data

US 2024/0263384 A1 Aug. 8, 2024

(30) Foreign Application Priority Data

Feb. 6, 2023 (IT) ..... 102023000001866

(51) Int. Cl.
*D06F 87/00* (2006.01)
*D06F 95/00* (2006.01)

(52) U.S. Cl.
CPC ..... *D06F 87/00* (2013.01); *D06F 95/00* (2013.01)

(58) Field of Classification Search
CPC ..... D06F 87/00; D06F 95/00; D06F 58/10; D06F 58/12; D06F 73/02
See application file for complete search history.

(56) References Cited

U.S. PATENT DOCUMENTS

| | | | | |
|---|---|---|---|---|
| 3,732,628 | A | 5/1973 | Blevens et al. | |
| 4,391,602 | A | 7/1983 | Stichnoth et al. | |
| 6,129,879 | A * | 10/2000 | Bersted | B29C 48/79 8/531 |
| 7,845,197 | B2 | 12/2010 | Frushtick | |
| 9,062,403 | B2 * | 6/2015 | Zaglio | D06F 58/10 |
| 2007/0261449 | A1 * | 11/2007 | McMillan | D06F 73/02 68/5 C |

FOREIGN PATENT DOCUMENTS

| | | | | |
|---|---|---|---|---|
| DE | 3600953 | A1 * | 7/1987 | |
| DE | 202006007364 | U1 | 8/2006 | |
| DE | 102007004473 | A1 * | 7/2008 | D06F 58/12 |
| WO | WO-2022034182 | A1 * | 2/2022 | |

OTHER PUBLICATIONS

Italian Search Report and Written Opinion from Italian Patent Application No. 102023000001866, dated Aug. 23, 2023.

* cited by examiner

*Primary Examiner* — Ismael Izaguirre
(74) *Attorney, Agent, or Firm* — JONES ROBB, PLLC

(57) ABSTRACT

A finishing tunnel for ironing dry garments and similar products comprises a steam chamber and a drying chamber located downstream of the steam chamber. The expansion chambers border the steam chamber and are separated from the steam chamber by a panel having a plurality of through-holes. The vaporizing nozzles are placed in the expansion chambers to feed thereto saturated steam before the steam flows in the steam chamber through the through holes.

13 Claims, 7 Drawing Sheets

FINISHING TUNNEL FOR IRONING DRY GARMENTS AND SIMILAR PRODUCTS

CROSS-REFERENCE TO RELATED APPLICATIONS

This application claims priority to Italian Patent Application No. 102023000001866, filed on Feb. 6, 2023, the entire content of which is incorporated by reference herein.

FIELD OF THE INVENTION

The present invention has as its object a finishing tunnel for ironing dry garments and similar products. In particular, the present invention has as its object the structure of the steam circuit whose function is to feed the steam into the steam chamber or chambers of the finishing tunnel.

BACKGROUND OF THE FINDING

The finishing tunnels for ironing dry garments are used in the field of large-scale distribution and logistics, where, for example, such garments, received from production sites, are unpacked and have to be ironed before delivering them to the points of sale.

A finishing tunnel for ironing dry garments is formed by a succession of chambers through which garments are passed while hanging. The finishing tunnels comprise two sections: a first section (with one or more chambers) into which pressurized steam is fed to "wet" the garments and iron them; a second section (with one or more chambers) into which hot and dry air is fed to dry the garments. Through the finishing tunnel, the dry garments are then first wetted/humidified and then dried.

It is known also the document U.S. Pat. No. 4,391,602A which shows a process and equipment for ironing and drying freshly washed articles. The articles, after the washing, are hung in a wet state and heated while the humidity is adjusted to a desired constant level. Then, the articles are mechanically ironed by continuously blowing hot air over their surfaces. The equipment comprises a steaming chamber and a drying chamber, arranged in series and connected by a conveyor, to enable the transport of the hung articles. On the walls of the steaming chamber there are orifices for the introduction of steam and nozzles for the introduction of hot air, while on the walls of the drying chamber there are nozzles for the introduction of hot air.

SUMMARY

In the field of finishing tunnels for ironing dry garments, the Applicant has observed that the steam emitted by the nozzles, which are positioned on the heating plates bordering the steam chamber or chambers, is emitted at a high temperature in order to have a low degree of humidity (dry steam) so as to avoid the formation of water droplets.

The Applicant has observed that the high temperature of steam and heating plates can damage garments, for example by generating unwanted marks on them.

Moreover, with regard to the above-mentioned known art document U.S. Pat. No. 4,391,602A, the Applicant observes that U.S. Pat. No. 4,391,602A shows a process and an equipment for ironing and drying freshly washed articles, which are therefore already wetted/wet, and not for treating dry articles as instead it is necessary in the large-scale retail and logistics. Therefore, the timing and properties of the steam used in U.S. Pat. No. 4,391,602A are different from those of the steam used in the steam chamber or chambers for ironing and drying dry articles. In fact, in U.S. Pat. No. 4,391,602A, freshly washed articles are hung in the wet state and heated with steam and air for a time about twenty times longer than the subsequent drying time with hot air.

The Applicant has set itself therefore the object of realizing a finishing tunnel for ironing dry garments and similar products that improves the quality of ironed articles.

It is in particular an object to realize a finishing tunnel for ironing dry garments and similar products that avoids the generation of undesirable marks on the treated garments due to the excessively high temperature of the steam and/or contact with excessively hot heating plates.

The Applicant has found that the indicated objects can be achieved by using expansion chambers wherein feeding the steam via the nozzles to make the steam flow subsequently into the steam chamber of the tunnel, in which the garments pass, via through holes made in the walls bordering the steam chamber on one side and such expansion chambers on the other.

In particular, the Applicant has found that the indicated objects and still others are substantially reached by an apparatus and a method for ironing dry garments and similar products according to one or more of the attached claims and/or according to one or more of the following aspects.

In particular, according to a first aspect, the present invention concerns a finishing tunnel for ironing dry garments and similar products, comprising:

- a casing delimiting internally at least one steam chamber and at least one drying chamber located downstream of said at least one steam chamber;
- handling devices configured to move garments and similar products through the steam chamber and then through the drying chamber;
- a hot air generator in fluid connection with the drying chamber;
- a steam generator;
- a plurality of vaporizing nozzles in fluid connection with the steam generator via at least one steam valve;
- a control unit operationally connected to the steam generator and/or to the steam valve;
- wherein the casing comprises interior walls delimiting said at least one steam chamber and has internally at least one expansion chamber bordering the steam chamber and separated from said steam chamber by a panel, wherein the panel is part of one of the interior walls, wherein the panel has a plurality of through-holes, wherein the vaporizing nozzles are placed in the expansion chamber to feed steam into said expansion chamber before the steam flows into the steam chamber through the plurality of through-holes;
- wherein said control unit is configured to emit from vaporizing nozzles saturated steam, optionally with the following properties: from 4 bar (143.6° C.) to 10 bar (179.9° C.) bar.

According to a second aspect, the present invention relates to a method for ironing dry garments and similar products through the finishing tunnel of one or more of the attached claims and/or according to one or more of the following aspects. The method comprises:

- hooking dry garments and similar products to the handling devices;
- passing the dry garments and similar products first through the steam chamber and then through the drying chamber;

wherein in the steam chamber the dry garments and similar products are wetted by the steam and in the drying chamber the garments and similar products are dried by the hot air;

wherein the steam is fed into the expansion chamber by the vaporizing nozzles and then flows in the steam chamber through the plurality of through-holes;

wherein the steam fed into the expansion chamber is saturated steam and optionally has the following properties: from 4 bar (143.6° C.) to 10 bar (179.9° C.).

wherein the steam in the steam chamber has optionally the following properties: from 0.1 to 1 bar.

The Applicant has verified that the apparatus and method of the present invention allow to improve the quality of ironing of the dry garments and similar products.

The Applicant has in fact verified that the expansion chamber or chambers with the through holes allow/s to improve the distribution of steam over the entire surface of the garments or similar products that transit in the steam chamber.

The Applicant has verified that the expansion chamber or chambers with the through holes allow/s to avoid that water droplets fall on the garments or similar products that transit in the steam chamber.

The Applicant has verified that the expansion chamber or chambers allow/s to avoid that the vaporizing nozzles, if they are too close to the garment to be ironed, they may leave marks on the garment itself.

The Applicant has furthermore verified that the presence of the expansion chamber or chambers with the through holes allows to use steam at a lower temperature because, even if the water droplets are greater in number at a lower temperature, most of these water droplets remain still trapped in the expansion chamber and cannot be deposited on the garments passing through the steam chamber.

The lower temperature of the steam and of the walls heated by the steam allows to avoid that the contact of the garments with such walls could mark the garments.

The Applicant has also verified that the adoption of a lower temperature allows to save energy.

Further aspects of the invention are listed below.

In an aspect, in said at least one expansion chamber and into said at least one steam chamber is fed only the steam coming from the vaporizing nozzles, no other nozzles are present for example for the introduction of hot air.

In an aspect, a first transit time of the garments and similar products through the steam chamber, i.e. a residence time of the garments and similar products in the steam chamber, is similar to a second transit time of the garments and similar products through the drying chamber, i.e. at a residence time of the garments and similar products in the drying chamber.

In an aspect, wherein a ratio of the first transit time of the garments and similar products in the steam chamber to the second transit time of the garments and similar products in the drying chamber is between 0.9 s and 1.3 s.

In an aspect, the first transit time is between 5 s and 15 s.

In an aspect, the second transit time is between 5 s and 20 s.

In an aspect, it is provided to unpack the dry garments and similar products and then hook them to the handling devices of the finishing tunnel, without subjecting said dry garments and similar products to any washing.

In an aspect, said at least one expansion chamber has a number of vaporizing nozzles less than a number of through holes of the panel.

In an aspect, a ratio of the number of through holes to the number of vaporizing nozzles is between 25 and 35.

In an aspect, said at least one expansion chamber has a number of vaporizing nozzles between 1 and 5.

In an aspect, the panel or the portion of the panel associated to said at least one expansion chamber has a number of through holes between 25 and 35.

In an aspect, a number of vaporizing nozzles per unit area of the respective interior wall is between 1 and 15.

In an aspect, a number of through holes per unit area of the respective interior wall is between 150 and 500, preferably between 120 and 170.

In an aspect, a diameter of each of the through holes is between 2 mm and 4 mm.

In an aspect, the interior walls comprise two parallel interior walls and bordering each other said at least one steam chamber; wherein each of said two parallel interior walls borders at least one respective expansion chamber.

In an aspect, the parallel interior walls are vertical.

In an aspect, the interior walls comprise a lower interior wall, wherein the lower interior wall borders at least one respective expansion chamber.

In an aspect, each of said two parallel interior walls adjoins a plurality of respective expansion chambers.

In an aspect, each of said two parallel interior walls borders a number of expansion chambers between 1 and 10.

In an aspect, the lower interior wall borders a number of expansion chambers between 1 and 2.

In an aspect, the expansion chambers are steam-tight separated from each other so that the steam present in an expansion chamber cannot flow directly into another expansion chamber.

In an aspect, a single panel is associated to a plurality of respective expansion chambers or a panel is associated to each expansion chamber.

In an aspect, said at least one expansion chamber has a flattened shape with a depth, measured orthogonally to the panel, less than a height and a width of said at least one expansion chamber.

In an aspect, the depth of said at least one expansion chamber is between 18 mm and 23 mm.

In an aspect, a ratio of a volume of the steam chamber to a volume of said at least one expansion chamber, or the sum of volumes of the expansion chambers, is between 10 and 320.

In an aspect, at least one inner conduit for transit of a hot fluid is arranged in proximity of said at least one interior wall.

In an aspect, the inner conduit is at least partially developed around said at least one expansion chamber.

In an aspect, the inner conduit is in fluid connection with the steam generator.

In an aspect, the finishing tunnel comprises a plurality of frames arranged in the casing, each of the frames comprising said at least one expansion chamber, preferably each of the frames comprising a plurality of expansion chambers.

In an aspect, the panel is associated to the frame and closes the expansion chamber or chambers.

In an aspect, a plurality of panels is associated to the frame and each panel closes one of the expansion chambers.

In an aspect, said at least one inner conduit is obtained in the frame or is associated to the frame.

In an aspect, the frame has a plurality of expansion chambers arranged one above the other and said at least one inner conduit has a serpentine shape that develops between the expansion chambers.

In an aspect, the frame has a rectangular shape with a larger vertical dimension and each of the expansion chambers has a rectangular shape with a larger horizontal dimension.

In an aspect, the frame has a number of vaporizing nozzles between 4 and 12.

In an aspect, each expansion chamber of the frame houses a number of vaporizing nozzles between 1 and 6.

In an aspect, the panel rests on the perimeter edges of the expansion chambers of the frame or each panel rests on the perimeter edges of a respective expansion chamber of the frame.

In an aspect, the steam chamber is delimited by two parallel, vertical and spaced apart frames.

In an aspect, the steam chamber is furthermore delimited by a horizontal lower frame.

In an aspect, the finishing tunnel comprises a plurality of steam chambers arranged in sequence.

In an aspect, the finishing tunnel comprises a plurality of drying chambers arranged in sequence.

In an aspect, the handling devices comprise hooks configured to hang the garments and similar products.

In an aspect, hangers bearing the garments and similar products can be hooked to the handling devices.

In an aspect, the garments and similar products are hung to the handling devices.

In an aspect, the garments and similar products hung to the handling devices are flattened and substantially lie in a plane parallel to the two parallel and vertical interior walls.

Further features and advantages will appear more clearly from the detailed description of a preferred, but not exclusive, embodiment of a finishing tunnel for ironing dry garments and similar products and of a method for ironing dry garments and similar products according to the present invention.

DESCRIPTION OF FIGURES

This description will be provided below with reference to the attached figures, which are provided for illustrative purposes only and are therefore not limiting, wherein.

DETAILED DESCRIPTION OF AN EMBODIMENT OF THE INVENTION

Figure 1:
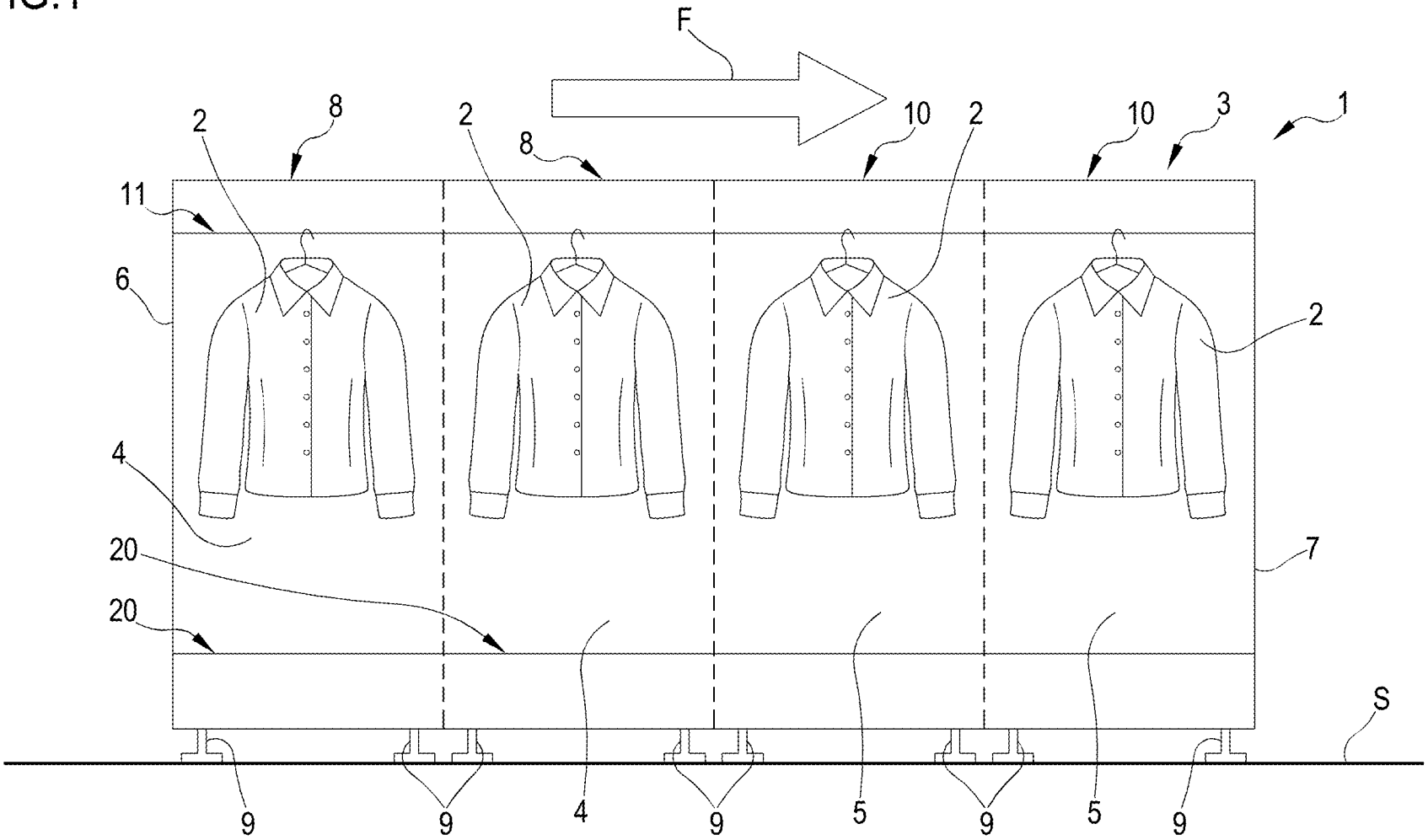
FIG. 1 shows a schematic view in side elevation and partially in transparency of a finishing tunnel for ironing dry garments according to the present invention.
Figure 2:
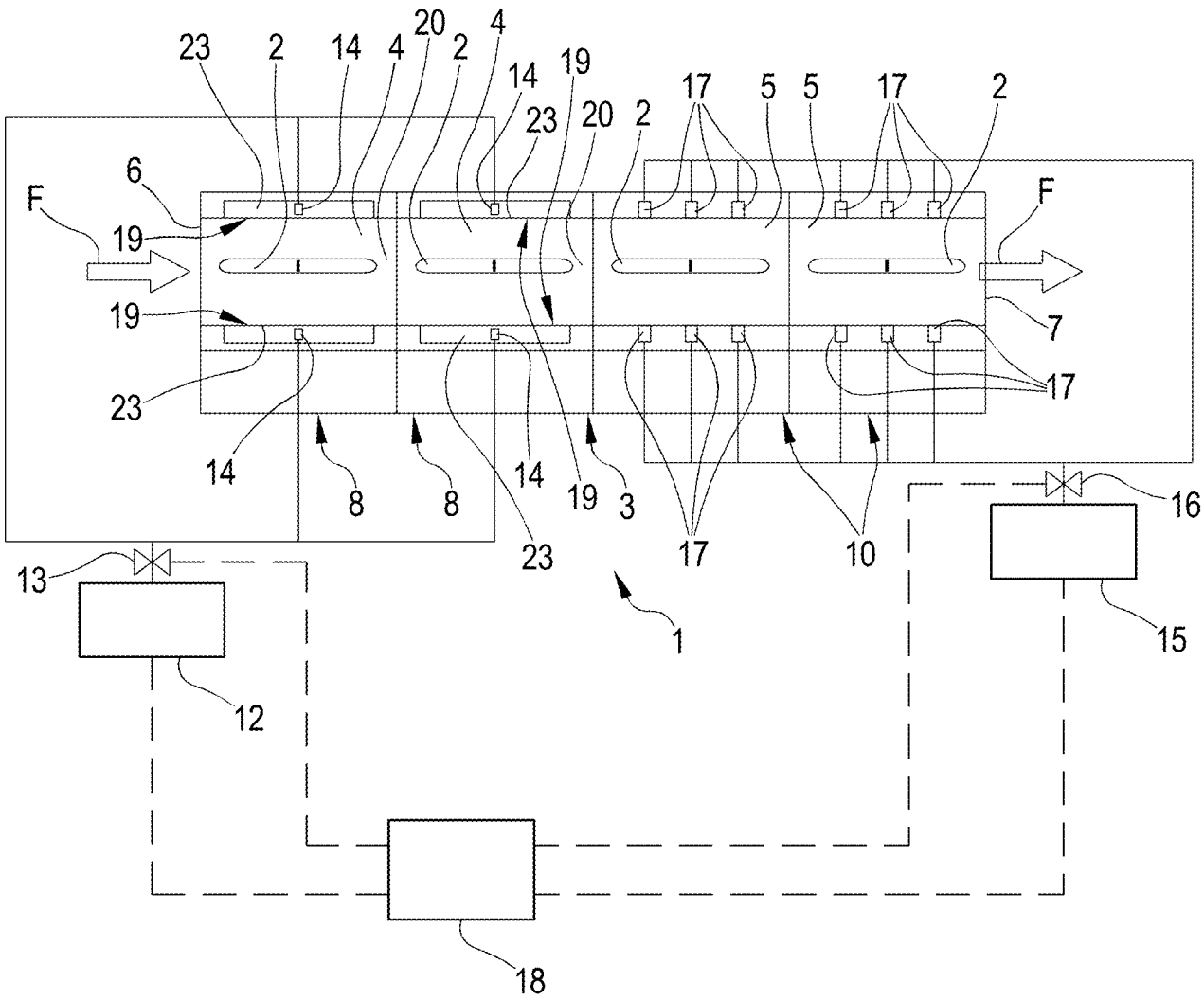
FIG. 2 shows a schematic view from above and partially in transparency of the finishing tunnel of FIG. 1.

With reference to FIGS. 1 and 2, with 1 has been overall indicated a finishing tunnel for ironing dry garments 2 and similar products. The finishing tunnel 1 is typically used in the field of large-scale distribution and logistics, where, for example, the garments 2, received from production sites, are unpacked and have to be ironed before delivering them to the points of sale. In any case, the finishing tunnel according to the present invention is configured to iron dry garments 2 (for example suits, blazers, jackets, shirts, sweaters, trousers, shirts) and similar products, i.e. water-free, and not freshly washed and still wetted garments as it is the case, for example, in the installations of industrial laundries. For simplicity, reference will be made in this description to only the garments 2 as a non-limiting example.

The finishing tunnel 1 is then configured to wet first the garments 2 by spraying them with steam and then drying the garments with hot air passing the garments 2 through the finishing tunnel 1.

For this purpose, the finishing tunnel 1 comprises a casing 3 delimiting internally at least one steam chamber 4 and at least one drying chamber 5 located downstream of said at least one steam chamber 4. In the shown embodiment, the finishing tunnel 1 comprises two steam chambers 4 placed in series followed by two drying chambers 5 placed in series. The steam chambers 4 and the drying chambers 5 delimiting internally to the casing 3 a path that develops from an inlet 6 to an outlet 7. The garments 2 enter, via the inlet 6, into a first steam chamber 4 and exit, via the outlet 7, from a last drying chamber 5.

In the shown exemplary embodiment, each steam chamber 4 is defined internally to a respective steam module 8 provided with feet 9 for ground support "S" and each drying chamber 5 is defined internally to a respective drying module 10 provided with feet 9 for ground support "S". The steam modules 8 and the drying modules 10 are side-by-side and connected so as to define the above-mentioned path.

The finishing tunnel 1 comprises furthermore handling devices 11 configured to move garments 2 through the steam chambers 4 and then through the drying chambers 5 from the inlet 6 to the outlet 7 and in a feeding direction "F".

The handling devices 11, only schematically represented in FIG. 1 as they can also be of a known type, comprise for example a chain driven by an appropriate motor. The chain is arranged at an upper portion of the steam chambers 4 and of the drying chambers 5 and its own branch extends along the aforementioned path. The garments 2 are hooked, for example via hangers, to such a chain or belt and are transported along the path in the feeding direction "F". For example, the chain or belt has hooks to which hang the hangers and thus the garments 2.

A steam generator 12 (FIG. 2) is in fluid connection, through appropriate conduits and a steam valve 13 or more steam valves, with vaporizing nozzles 14 located in the steam modules 8, to feed the steam into the steam chambers 8 according to the modes detailed below. Analogously, a hot air generator 15 is in fluid connection through appropriate conduits and a hot air valve 16 or more hot air valves, with openings 17 located in the drying chambers 9 to feed the hot air into the drying chambers 9.

A control unit 18 (FIG. 2), for example of electronic type, is operationally connected to the steam generator 12, to the steam valve 13, to the hot air generator 15 and to the hot air valve 16, to control and adjust the steam emitted by the vaporizing nozzles 14 and the hot air emitted by the openings 17.

In variant embodiments, not shown, the drying chamber 9, instead of the shown openings 17, comprises a fan to recirculate hot air between said drying chamber 9 and a compartment of the drying module 10. The compartment is side-by-side to the drying chamber 9 and within it is located a heated radiator (for example through the steam itself) configured to bring the air to the desired temperature for drying the garment. The control unit 18 controls therefore the fan and/or radiator. For example, the control unit 18 controls a speed of the fan and/or a flow rate of steam in the radiator. The hot air generator is therefore defined by the radiator inserted in the compartment.

Each of the steam modules 8 comprises two vertical interior walls 19, parallel and mutually spaced, and a lower interior wall 20 which, together with an upper portion at which the chain or belt is placed, delimit the steam chamber 4. The steam module 8 and the respective steam chamber 4 show therefore an inlet and an outlet for the garments 2 transiting horizontally along the feeding direction "F". The garments 2, hung through the hangers, are flattened and substantially lie in a plane parallel to the two vertical and parallel interior walls 19.

Figure 3:
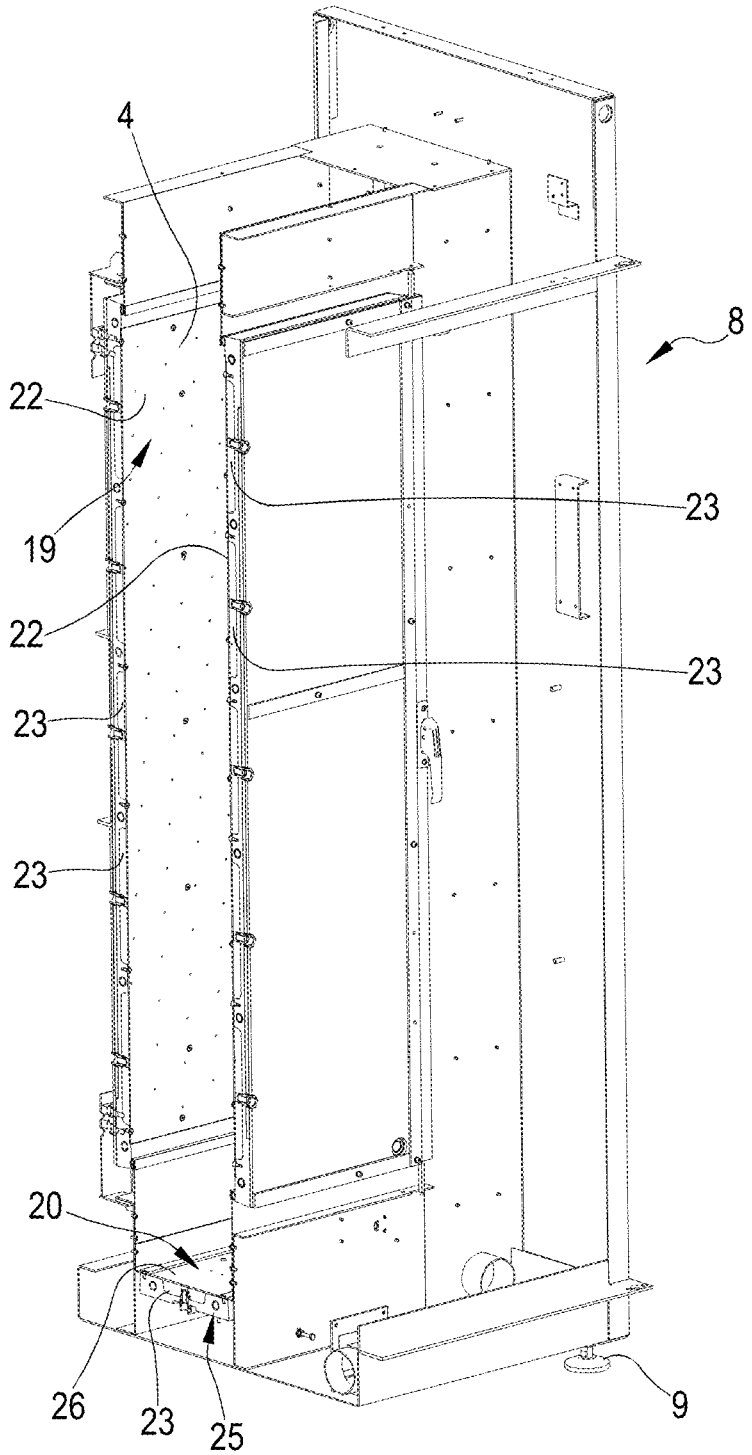
FIG. 3 is a three-dimensional sectional view of a steam chamber of the finishing tunnel of FIGS. 1 and 2.
Figure 4:
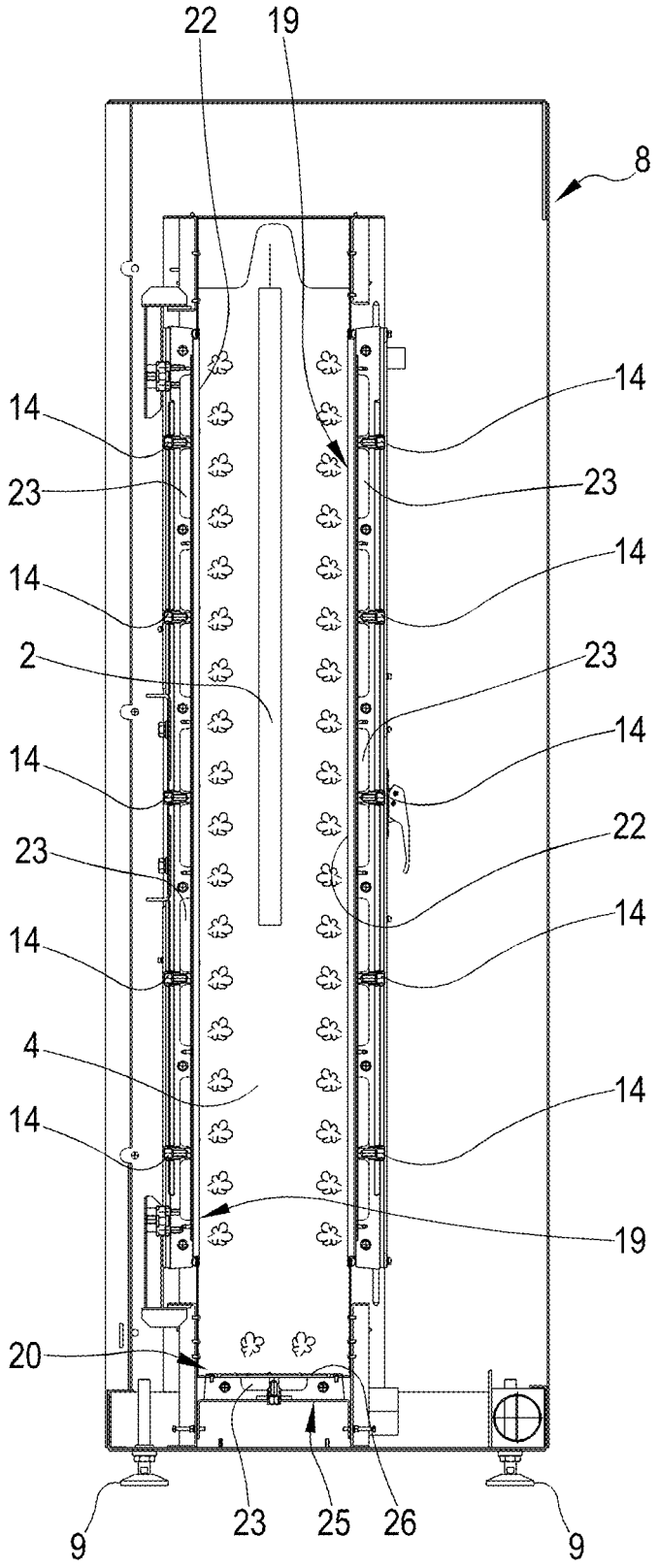
FIG. 4 shows a two-dimensional sectional view of the portion of FIG. 3.
Figure 5:
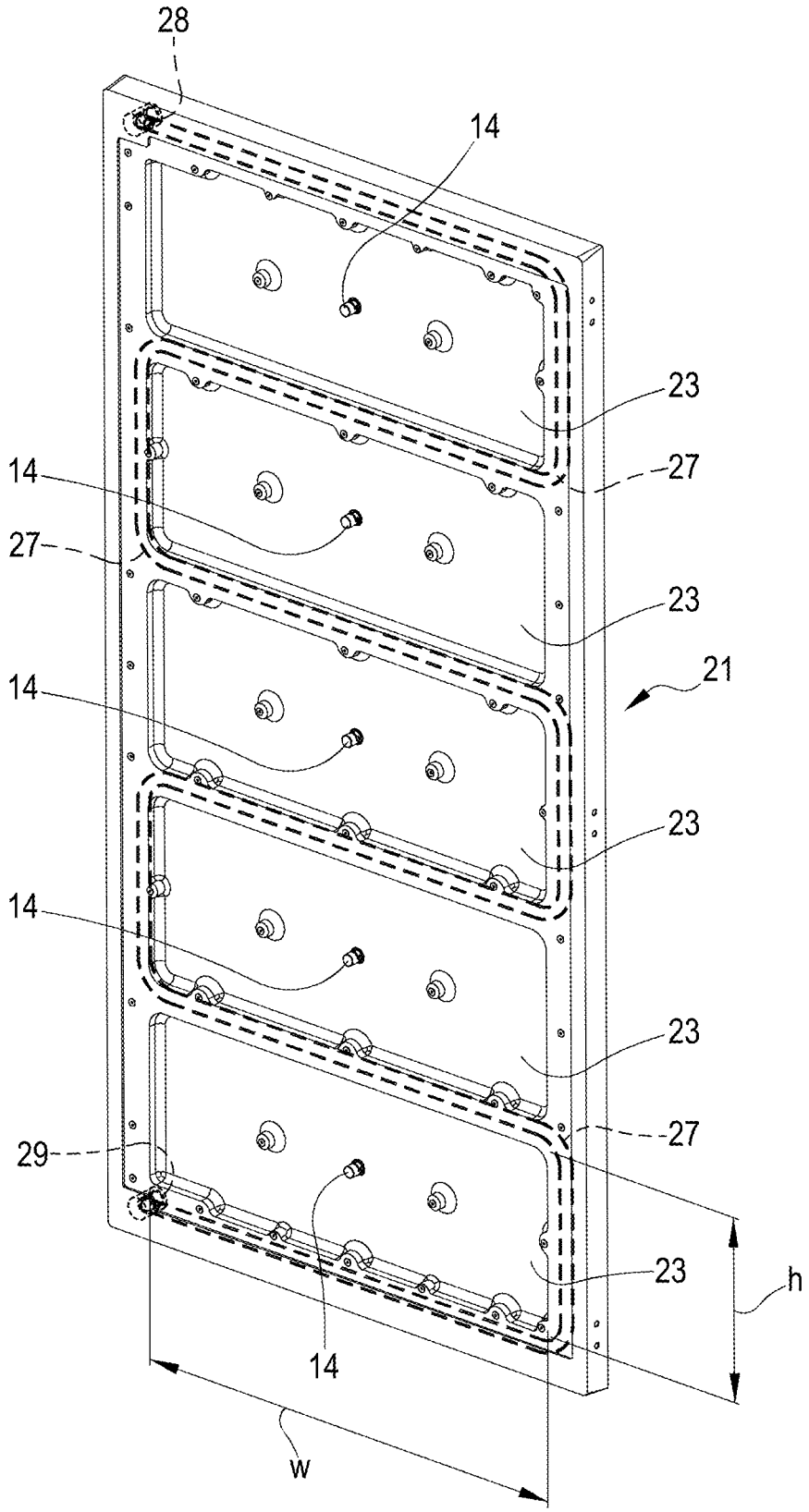
FIG. 5 is a three-dimensional view of an element of the portion of FIGS. 3 and 4.

As better visible in figures from 3 to 7, each vertical interior wall 19 is defined by a frame 21 that has a rectangular shape with a greater vertical dimension. In the frame 21 are defined a plurality of recesses of rectangular shape with a greater horizontal dimension. (FIG. 5). These recesses are closed by a panel 22, visible in FIGS. 3, 4 and 7, and define respective expansion chambers 23. In the shown example, the expansion chambers 23 are five arranged one above the other.

Figure 7:
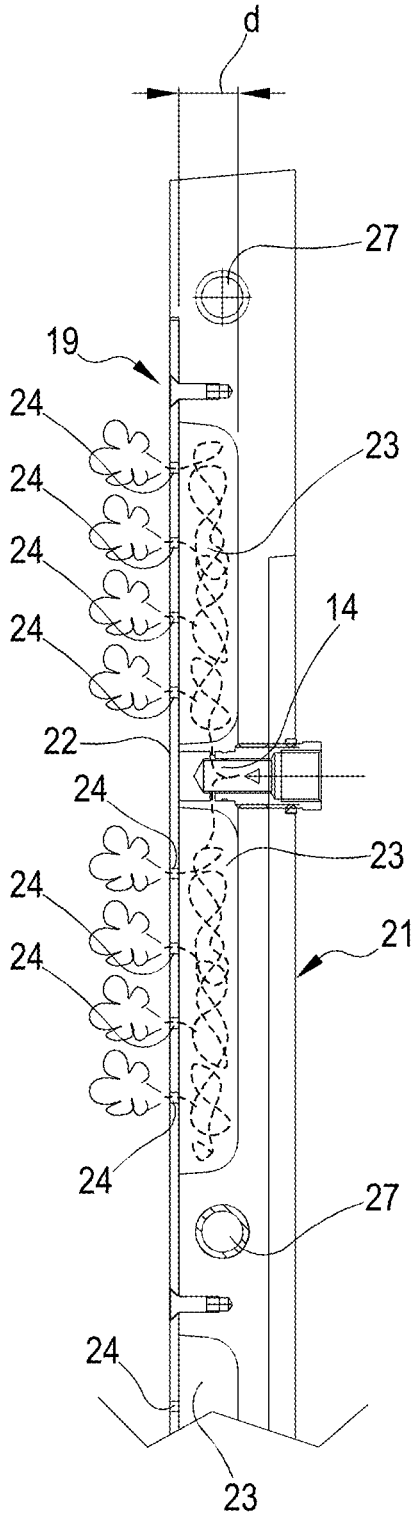
FIG. 7 is a partial section of the element of FIGS. 5 and 6.

Each expansion chamber 23 has a flattened shape with a depth "d", measured orthogonally to the panel 22, less than a height "h" and of a width "w" thereof. For example, the height "h" of each expansion chamber 23 of the frame 21 is equal to 265 mm, the width "w" is equal to 652 mm (FIG. 5) and the depth "d" is equal to 22 mm (FIG. 7). A volume of each expansion chamber 23 of the frame 21 is therefore equal to about 3.800.000 $mm^3$.

In each expansion chamber 23 is placed one of the vaporizing nozzles 14 and the panel 22 has a plurality of through-holes 24 that put in fluid communication each one of the expansion chambers 23 with the steam chamber 4. In other words, each expansion chamber 23 is separated from the steam chamber 4 by the panel 22 which therefore defines, at least in part, one of the interior walls. The steam is fed into the expansion chamber 23 by the vaporizing nozzle 14 and then flows in the steam chamber 4 through the plurality of through-holes 24.

In particular, in the shown embodiment, a unique panel 22 covers and closes all the recesses and has a plurality of portions, each associated to a respective recess, provided with the above-mentioned through holes 24. The panel 22 rests on the perimeter edges of the expansion chambers 23 of the frame 21. Each portion has tens of through holes 24. The steam is then fed into one of the expansion chambers 23 by a single vaporizing nozzle 14 and then the steam of this expansion chamber 23 flows into the steam chamber 4 through the tens of through holes 24. For example, the through holes 24 associated to an expansion chamber 23 are thirty-two and in the expansion chamber 23 is present only the mentioned single vaporizing nozzle 14. The expansion chambers 23 are steam-tight separated from each other so that the steam present in an expansion chamber 23 cannot flow directly into another expansion chamber 23.

The lower interior wall 20 is defined by a lower frame 25 that has a rectangular shape. In the lower frame 25 is defined a recess of rectangular shape closed by a lower panel 26 so as to define a respective expansion chamber 23. In this expansion chamber 23 is arranged one of the vaporizing nozzles 14 and the lower panel 26 has a plurality of through-holes 24 that put in fluid communication this expansion chamber 23 with the steam chamber 4. For example, the through holes 24 associated to the expansion chamber 23 of the lower interior wall 20 are sixteen. For example, the height "h" of the expansion chamber 23 of the lower frame 25 is equal to 113 mm, the width "w" is equal to 627 mm and the depth "d" is equal to 22 mm. A volume of the expansion chamber 23 of the lower frame 25 is equal to about 1.560.000 $mm^3$.

The steam module 8 shown as a non-limiting example comprises then eleven expansion chambers 23 (five on each side and a lower one), eleven vaporizing nozzles 14 and three hundred and thirty-six through holes 24. A ratio of the number of through holes 24 to the number of vaporizing nozzles 14 of the steam module 8 is equal to 30.5. A diameter of each of the through holes 24 is equal to 3 mm.

The steam chamber 4 therefore borders the aforementioned eleven expansion chambers 23 and is separated from these expansion chambers 23 by the panels 22 and by the lower panel 26. Each of said two vertical and parallel interior walls 19 borders five expansion chambers 23 and the lower interior wall borders an expansion chamber 23.

A ratio of a volume of the steam chamber 4 to a total volume of the expansion chambers 23 is equal to 12.3.

In not shown variant embodiments, the ratio of the number of through holes 24 to the number of vaporizing nozzles 14 can be between 5 and 20 each expansion chamber 23 can have a number of vaporizing nozzles 14 between 1 and 5 the panel 22 or the portion of the panel 22 or the lower panel 26 associated to one of the expansion chambers 23 has a number of through holes 24 between ten and one hundred; a number of vaporizing nozzles 14 per unit area of the respective interior wall 19, 20 is between 1 and 15 a number of through holes 24 per unit area of the respective interior wall 19, 20 is between 150 and 500 the diameter of each of the through holes is between 2 mm and 4 mm; each of the two vertical and parallel interior walls 19 borders a number of expansion chambers 23 between one and eight; the lower interior wall 20 borders a number of expansion chambers 23 between one and four; the depth "d" of the expansion chamber 23 is between 18 mm and 23 mm; a ratio of the volume of the steam chamber 4 to the sum of the volumes of the expansion chambers 23 is between 10 and 20. Furthermore, instead of a single panel 22, the frame 21 may comprise a plurality of panels 22, each one associated to a respective expansion chamber 23. Each panel 22 rests on the perimeter edges of a respective expansion chamber 23.

Figure 6:
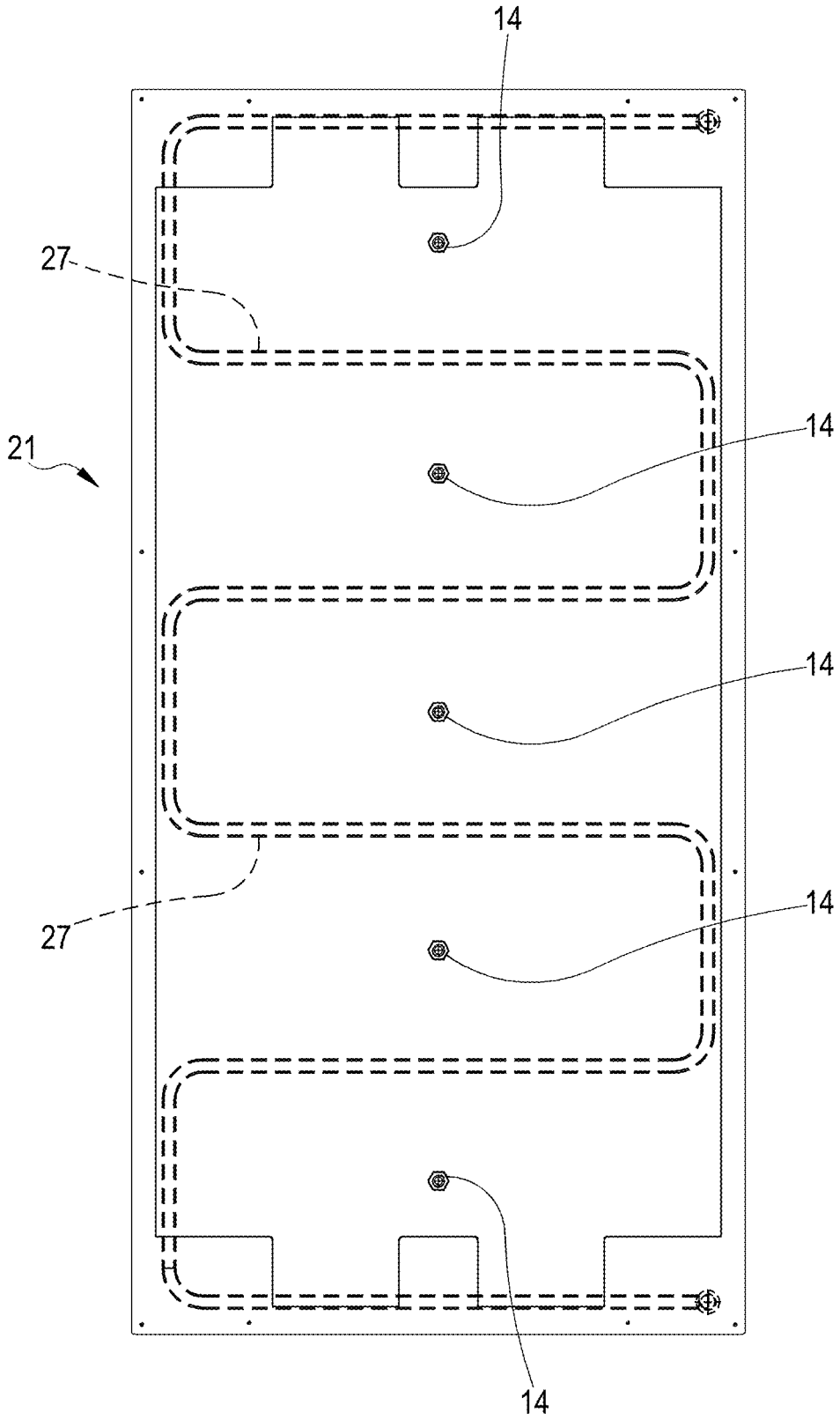
FIG. 6 is a front view of the element of FIG. 5.

As visible in FIGS. 5, 6 and 7, the frame 21 has also an inner conduit 27 for the transit of a hot fluid, as for example the steam itself injected by the vaporizing nozzles 14. In this case, the inner conduit 27 is in fluid connection with the steam generator 12.

The inner conduit 27 is arranged in proximity of the vertical interior wall 19 to heat it, in particular to heat the portions surrounding the expansion chambers 23 and are not in direct contact with the steam contained in said expansion chambers 23. The inner conduit 27 is obtained in the frame 21 and has a serpentine shape that develops between the expansion chambers 23 and partially around each expansion chamber 23.

In FIG. 5 it is visible an inlet 28 of this inner conduit 27 located at an upper corner of the frame 21 and an outlet 29 of this inner conduit 27 located at a lower corner of the frame 21.

The control unit 18 is configured to emit from the openings 17 hot air with the following properties: from 20° C. to 180° C. The control unit 18 is configured to emit from vaporizing nozzles 14 and emit into the expansion chambers 23 saturated steam, preferably with the following properties: from 4 bar (143.6° C.) to 10 bar (179.9° C.).

Pressure of the saturated steam is the saturation pressure, i.e. it is the pressure at which water changes phase at a given temperature. Saturation temperature of steam is the temperature at which water changes phase at a given pressure.

| P of steam | | T of saturation |
|---|---|---|
| 4 bar | 4.079 kg/cm$^2$ | 143.6° C. |
| 10 bar | 10.197 kg/cm$^2$ | 179.9° C. |

Into the expansion chambers 23 and into the steam chamber 4 is fed only the steam deriving from the vaporizing nozzles 14 and are not present nozzles for the introduction of hot air.

The steam emitted by the vaporizing nozzles 14 expands and cools down in the expansion chambers 23 and then passes through the through holes 24 and enters in the steam chamber 4. Therefore, the steam present in the steam chamber 4 that wets the garments 2 has for example the following properties: from 0.1 bar to 1 bar. The expansion and the cooling of the steam in the expansion chambers and the introduction of the steam in the steam chamber through the through holes allow to improve the distribution of the steam on the entire surface of the garments and to avoid that an excessively high temperature of the steam and/or of the walls and/or the proximity with the vaporizing nozzles can damage the garments. Furthermore, the expansion chambers retain any drops of water and avoid that they are deposited on the garments.

In use and according to the method of the present invention, the garments 2 arriving from the production sites are unpacked and, without being subjected to any washing cycle, are hooked up to the handling devices 11 of the finishing tunnel 1 at the inlet 6. The garments 2 entering the finishing tunnel 1 are therefore dry.

The handling devices 11 carry the garments 2, hung and lying substantially in the plane parallel to the two vertical and parallel interior walls 19, along the feeding direction "F", first through the two steam modules 8 and then through the two drying modules 10.

The garments 2 are wetted by the steam in the two steam modules 8 and then dried by the hot air in the two drying modules 10. A linear speed conferred to the garments 2 by the handling means 11 and the dimensions of the steam modules 8 and of the drying modules 10 are such that a first transit time "t1" of the garments 2 through the steam chambers 4, i.e. a residence time of the garments 2 in the steam chambers 4, is similar to a second transit time "t2" of the garments 2 through the drying chambers 5, i.e. at a residence time of the garments 2 in the drying chamber 5. A ratio of the first transit time "t1" to the second transit time "t2" can be between 0.9 and 1.3. For example, the first transit time is between 5 s and 15 s and the second transit time is between 5 s and 20 s.

LIST OF ELEMENTS

1 finishing tunnel
2 garments
3 casing
4 steam chamber
5 drying chamber
6 inlet
7 outlet
8 steam module
9 feet
10 drying module
11 handling devices
12 steam generator
13 steam valve
14 vaporizing nozzles
15 hot air generator
16 hot air valve
17 openings
18 control unit
19 vertical interior walls
20 lower interior wall
21 frame
22 panel
23 expansion chambers
24 through holes
25 lower frame
26 lower panel
27 inner conduit
28 inlet
29 outlet
S ground
F feeding direction
h height
W width
d depth
t1 first transit time
t2 second transit time

The invention claimed is:

1. A finishing tunnel for ironing dry garments and similar products, comprising:

a casing delimiting internally at least one steam chamber and at least one drying chamber located downstream of said at least one steam chamber;

handling devices configured to move garments and similar products through the steam chamber and then through the drying chamber;

a hot air generator in fluid connection with the drying chamber;

a steam generator;

a plurality of vaporizing nozzles in fluid connection with the steam generator via at least one steam valve; and a control unit operationally connected to the steam generator and/or to the steam valve;

wherein the casing comprises interior walls delimiting said at least one steam chamber and has internally at least one expansion chamber bordering said steam chamber and separated from said steam chamber by a panel, wherein the panel is part of one of the interior walls, wherein the panel has a plurality of through-holes, wherein the vaporizing nozzles are placed in the expansion chamber to feed steam into said expansion chamber before the steam flows into the steam chamber through the plurality of through-holes; and wherein said control unit is configured to emit from the vaporizing nozzles saturated steam with the following properties: from 4 bar (143.6° C.) to 10 bar (179.9° C.).

2. The finishing tunnel of claim 1, wherein said at least one expansion chamber has a number of vaporizing nozzles less than a number of through holes of the panel, optionally wherein a ratio of the number of through holes to the number of vaporizing nozzles is between twenty and one hundred.

3. The finishing tunnel of claim 1, wherein said at least one expansion chamber has a number of vaporizing nozzles between one and four; wherein the panel associated with said at least one expansion chamber has a number of through holes between ten and one hundred.

4. The finishing tunnel of claim 1, wherein a number of vaporizing nozzles per unit area of the respective interior wall is between 1 and 15; wherein a number of through holes per unit area of the respective interior wall is between 150 and 500.

5. The finishing tunnel of claim 1, wherein said interior walls comprise two vertical and parallel interior walls and bordering each other said at least one steam chamber; and wherein each of said two vertical and parallel interior walls borders at least one respective expansion chamber.

6. The finishing tunnel of claim 5, wherein each of said two vertical and parallel interior walls adjoins a plurality of respective expansion chambers.

7. The finishing tunnel of claim 6, wherein a number of expansion chambers is between one and eight.

8. The finishing tunnel of claim 1, wherein said at least one expansion chamber has a flattened shape with a depth, measured orthogonally to the panel, less than a height and a width of said at least one expansion chamber.

9. The finishing tunnel of claim 1, wherein a ratio of a volume of the steam chamber to a volume of said at least one expansion chamber is between 10 and 320.

10. The finishing tunnel of claim 1, wherein at least one inner conduit for transit of a hot fluid is arranged at said at least one interior wall; and wherein the inner conduit is at least partially developed around said at least one expansion chamber.

11. The finishing tunnel of claim 10, wherein the inner conduit is in fluid connection with the steam generator.

12. A method for ironing dry garments and similar products through the finishing tunnel of claim 1, wherein the method comprises:

hooking dry garments and similar products to the handling devices; and passing the dry garments and similar products first through the steam chamber and then through the drying chamber;

wherein in the steam chamber the dry garments and similar products are wetted by the steam and in the drying chamber the dry garments and similar products are dried by the hot air;

wherein steam is fed into the expansion chamber by the vaporizing nozzles and then flows into the steam chamber through the plurality of through-holes;

wherein the steam fed into the expansion chamber is saturated steam and has the following properties: from 4 bar (143.6° C.) to 10 bar (179.9° C.); and wherein the steam in the steam chamber has the following properties: from 0.1 bar to 1 bar.

13. The method of claim 12, wherein a ratio of a first transit time of garments and similar products through the steam chamber to a second transit time of the garments and similar products through the drying chamber is between 0.9 and 1.3.

* * * * *